United States Patent [19]

Wolter et al.

[11] 4,085,315

[45] Apr. 18, 1978

[54] LIGHT CONNECTABLE WITH A KEY

[75] Inventors: Heinz Wolter, Stadtwaldgurtel 4, 5000 Cologne 41, Germany; Brigitte Wolter, Cologne, Germany

[73] Assignee: Heinz Wolter, Cologne, Germany

[21] Appl. No.: 657,397

[22] Filed: Feb. 12, 1976

[30] Foreign Application Priority Data

Jun. 26, 1975 Germany ..... 2528498

[51] Int. Cl.[2] ..... F21V 33/00

[52] U.S. Cl. ..... 362/116; 362/200

[58] Field of Search ..... 240/2.13, 6.4 K, 6.4 R

[56] References Cited

U.S. PATENT DOCUMENTS

| | | | |
|---|---|---|---|
| 3,256,428 | 6/1966 | Schwartz | 240/6.4 R |
| 3,310,668 | 3/1967 | Schwartz | 240/6.4 R |

*Primary Examiner*—Monroe H. Hayes

*Attorney, Agent, or Firm*—Martin A. Farber

[57] ABSTRACT

A light which is connectable with a key and which comprises a housing receiving an incandescent bulb and battery, the key handle being braced against one side of the housing by means of a screw or the like which passes through the key handle hole. The light is characterized by clamping the key handle against a self-adhesive layer.

5 Claims, 13 Drawing Figures

FIG. 5
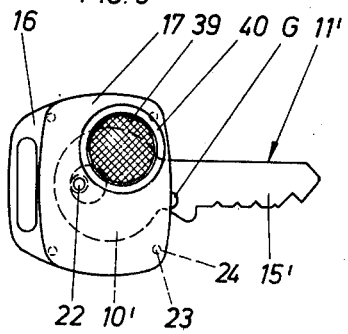
FIG. 6
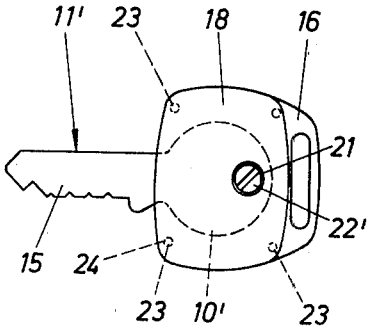
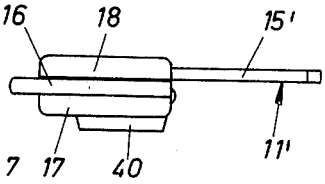
FIG. 7
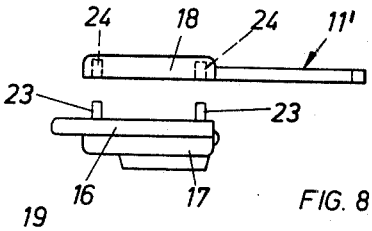
FIG. 8
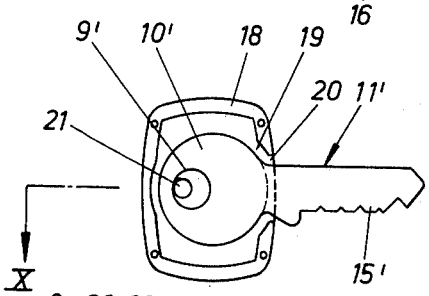
FIG. 9
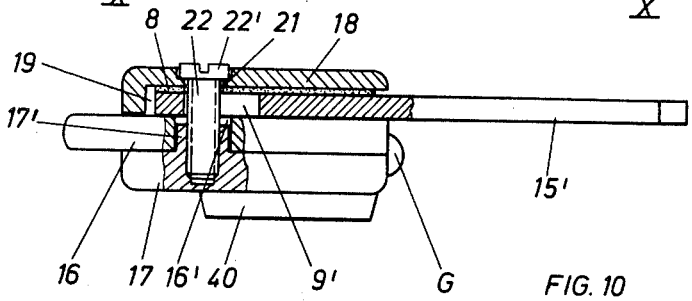
FIG. 10

LIGHT CONNECTABLE WITH A KEY

The invention relates to a light which is connectable with a key and which comprises a housing receiving an incandescent bulb and battery, the key handle being braced against one side of the housing by means of a screw or the like which passes through the key handle hole.

By a known embodiment (U.S. Pat. No. 3,310,668) the housing or casing comprises a push-in bottom cavity or slot for the key. Further a cartridge is encased in the casing together with a U-shaped fastening element. One U-leg of this fastening element steps engagingly against a wide surface of the key handle and projects with a pressed out portion in the key handle opening. The screw steps engagingly in this pressed out portion, which screw braces the key handle between one wall of the casing and the U-leg. This construction is expensive in technical commercial production. Moreover, only keys corresponding to the shape of the slot can be held. If the shape of the key handle deviates with respect to the shape of the slot, another shaped housing must be available for use. This requires an extensive production connected with increased stock or storage expenses. If one wants to use, or insert, a key with a key handle which is smaller relative to the slot, the danger exists that the casing twists or distorts relative to the key shank, since the force of the clamping screw is not sufficient. For the most part it merely serves the purpose that the key can not be pulled out from the slot.

It is an object of the invention, particularly additional to those objects gathered from the specification and claims, to provide a light which is connectable with a key in accordance with the generic introductory mentioned type, of simple technical manufacture and of use advantageous construction, such that despite avoidance of a positive or complementary encompassing of the key handle, yet there is attained a stable securing of the key to the light.

In accordance with the present invention, this object is solved yet in accordance with another object of the invention, in that the clamping of the key handle is effected against a self-sealing (i.e., self-sticking) adhesive layer.

As a consequence of such formation, a light with a connectable key of the introductory mentioned generic type is produced, which on the one hand is distinguished by a simplified construction, and on the other hand by an increased serviceability. For the reception of the key handle no opening positively adjusted or complementary to the handle is required to be formed or coordinated on the light housing. Nevertheless a large number of differently or variously shaped keys may be safely and surely secured on the light housing. During the tightening of the screw which passes through the hole in the key handle, one of the wide surfaces of the key handle steps abuttingly against the adhesive sealing layer, whereby the non-turnable connection of the key to the light housing is achieved. Itself when there is to exist projections — for example in the form of stamps or impressions, or defining elevated portions spaced from one another — on the key surface which points to the self-sealing adhesive layer, an absolute surface engagement contact is attained due to the elastic resilient self-sealing adhesive layer, which indeed still improves the securing of the key to the light housing. For the fastening of the keys with different key handles the fact is to the contrary that the key handle hole or opening — as was found — almost always lies at the same position. A key connected with the light according to need can also be exchanged for another. For this, the screw is simply to be released or unscrewed, the already present key is to be removed from the self-sealing adhesive layer, and the new key is to be coordinated thereto in its place. Possibly the old self-sealing adhesive layer can be replaced by a new self-sealing adhesive layer which is provided on both sides with a protective foil before the adherence.

An advantageous feature of the invention resides in positioning the self-sealing adhesive layer on an off-set step of the key mounting plate of the light housing. The height of the step corresponds approximately to the thickness of the self-sealing adhesive layer plus the thickness of the key. The key handle extends with fastened key between the self-sealing adhesive layer and the head of the screw. This fastening is very simple in its construction and arrangement and is extremely inexpensive to produce. With a fastening of the key and exchange or replacement of the same for another, respectively, the lamp housing does not need to be dismounted or taken apart.

It proves advantageous in accordance with the invention that the clamping screw simultaneous is the fastening or locking screw of the light housing. In this manner the clamping screw fulfills a double function with economization or minimization of the construction parts belonging to the light housing.

An advantageous variation according to the invention is realized in the manner that to the base plate of the light housing there is coordinated a clamping plate carrying the self-sealing layer in a recess which is enlarged with respect to the key handle, the recess of the clamping plate transferring or passing into a slot which serves for the passage therethrough of the key shank. The key handle is covered completely with the key fastened on the light housing. The depth of the recess in the clamping plate is smaller than the thickness of the key plus the thickness of the self-sealing layer, so that the key always is held in position clamped to the self-sealing layer by means of the clamping screw. The recess which is enlarged with respect to the key handle permits thereby the fastening of keys with differently shaped handles.

Beyond that the invention is advantageous in that the base plate of the light housing bears a pot-shaped recess for the positive non-rotatable interpositioning therein of a contact plate, which has a laterally directed wing with a contact finger which is angled-off from the wing, which finger steps engagingly against the central contact of the incandescent lamp stored in the adjacent recess. Above the contact plate there extends a preferably conically-shaped compression spring, the free end of which is supported on the wide surface of the button cell battery serving as the switch-on contact member; the peripheral line of the button cell battery is tangential to the complementary storage recess for the incandescent lamp, which storage recess is also provided in the housing cover. In this manner the clamping plate, the base plate and the housing cover can exhibit a very low construction height. These three construction parts are held together by means of the clamping screw which also fixes or secures the key. Nevertheless, during the insertion of the key, the housing cover and the base plate are not required to be disassembled or taken apart. These are first only to be separated if a new battery or possibly a burned out incandescent bulb is to be replaced or inserted. Also this can occur in the simplest manner. The contact plate with its angled-off contact finger permits larger tolerances with the incandescent bulb base, so that always the sure positive functioning of the light is guaranteed. For making contact, by the advantageous positioning of the electrical construction parts in the light housing, the battery itself is yet utilized in such a manner that it steps with its circumferential line against the base of the incandescent bulb during the switching-on of the light.

It is yet advantageous in accordance with the invention that the contact plate includes a projection for holding the compression spring. The projection of the contact plate causes the compression spring to be held remaining in its position relative to the contact plate during the dismounting apart of the base plate and the housing cover apart from each other. On the other hand the projection brings about a bracing or restraint of the base-winding course of the compression spring against the wall of the positive locking or complementary recess, so that also the contact plate thereby is held in the latter by force of the spring. This facilitates the assembling of both of the housing parts, namely, the housing cover and the base plate. The projection could also materialwise-integrally emerge from the wall of the pot-shaped recess. The projection would then also be formed on or attached to the base plate during manufacture.

With the above and other objects in view, the invention will become more clearly understood from the detailed description of preferred embodiments of the invention in connection with the drawings, of which:

FIG. 5 is a plan view toward the light connectable with a key in accordance with another embodiment of the invention;

FIG. 6 is a view of the opposite side of FIG. 5;

FIG. 7 is a side view of FIG. 5;

FIG. 8 is a view corresponding to FIG. 7 however with clamping plate detached from the base plate of the light housing; FIG. 9 is a plan view of the embodiment of FIGS. 5 – 8, toward the clamping plate with an inserted key;

FIG. 10 is a section taken along the lines X — X of FIG. 9;

Figure 1:
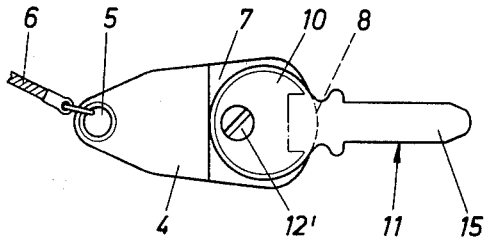
FIG. 1 is a plan view toward a light which is connectable with a key in accordance with the invention.
Figure 2:
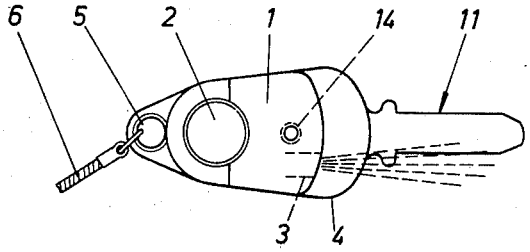
FIG. 2 is a view of the opposite side of FIG. 1.
Figure 3:
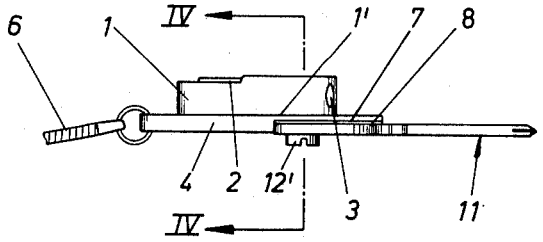
FIG. 3 is a side view of the light of FIG. 1.
Figure 4:
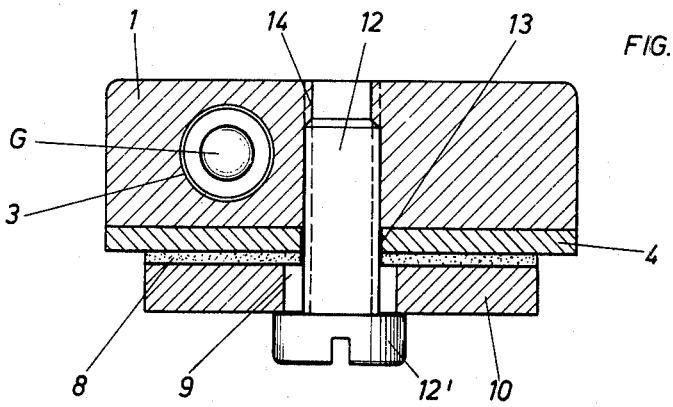
FIG. 4 is a section taken along the lines IV — IV of FIG. 3 in enlarged illustration.

Referring now to the drawings and more particularly to FIGS. 1 – 4, in accordance with the present invention a light includes a light housing 1. The latter receives therein a button cell battery 2 which serves as a switch-on push button, as well as receiving an incandescent bulb or lamp G. The latter extends in a pit or hole 3 formed in the lamp housing 1.

Against the surface 1' of the lamp or light housing 1 which surface 1' is opposite to the button cell battery 2, there engages a key carrying or mounting plate 4. The latter projects overlappingly on both sides of the light housing 1 (as may be seen in FIGS. 2 and 3). The end of the key mounting plate 4 adjacent to the button battery cell 2 is formed with an eyelet 5 for fastening thereto a carrying chain 6. The other end of the key mounting plate 4 is provided with a set off shoulder step 7. A self-sealing adhesive layer 8 is disposed, secured or adhering, on the surface of the step 7. In the illustrated embodiment example, although not limited thereto, the self-sealing layer 8 has a circular shape. A key handle 10 of a flat key 11, which handle is formed with a key handle hole 9, steps or is placed in abutment against the self sealing adhesive layer 8.

A fixing or clamping screw 12 passes through the key handle hole 9 as well as through a bore 13 in the key mounting plate 4 and grips engagingly in a thread 14 formed in the light housing 1. The screw head 12' is supported on the other wide surface of the key handle 10. The screw head 12 is selected to be larger in diameter than that of the hole 9 of the key handle 10. If necessary, a washer can be provided between the screw head 12' and the key handle 10. The screw thus locks the housing by securing the separate mounting plate 4 (also constituting by definition a part of the housing) to the housing 1 as well as serving to clamp the key to the adhesive layer 8.

The key 11 is secured such that its key shank 15 lies in the longitudinal direction of the light housing, in which, likewise, the light beam passes.

Referring now again to the drawings, and more particularly to FIGS. 5 – 13, in accordance with a second embodiment example of the present invention, the light housing comprises a base plate 16, a housing cover 17 and a clamping or hold-down plate 18.

The clamping plate 18 is formed with a recess 19 which is enlarged with respect to the key handle 10' of the flat key 11'. This recess 19 which is adjusted or adapted in order to receive the most common or prevalent keys, transfers or passes into a slot 20, the latter serving for the passage therethrough of the key shank 15'. As can be recognized from FIG. 10, the depth of the recess 19 is smaller that the key thickness plus the self-sealing adhesive layer 8.

In the clamping plate 18 there is located a passage hole 21 for clamping or fixing screw 22 which freely passes therethrough and through the self-sealing adhesive layer 8, the key handle hole 9', a bore 16' of the base plate 16 and which grippingly engages in the thread of the housing cover 17. For the purpose of attaining a large screw-in length, a collar 17' extends from the housing cover 17, the collar 17' projecting in the bore 16' of the base plate 16. By means of the clamping screw 22, the base plate 16 is clamped between the housing cover 17 and the clamping plate 18. For the screw head 22', a depression or countersink is provided in the clamping plate 18 such that the screw head 22' projects only insignificantly or indeed not at all all beyond the corresponding wide surface of the clamping plate 18.

In the base plate 16 there are seated guide pins 23 which project therefrom through opposite wide surfaces of the base plate 16. Openings 24 corresponding to the pins 23 are provided in the clamping plate 18 and in the housing cover 17 for reception of the guide pins 23 therein.

Figure 12:
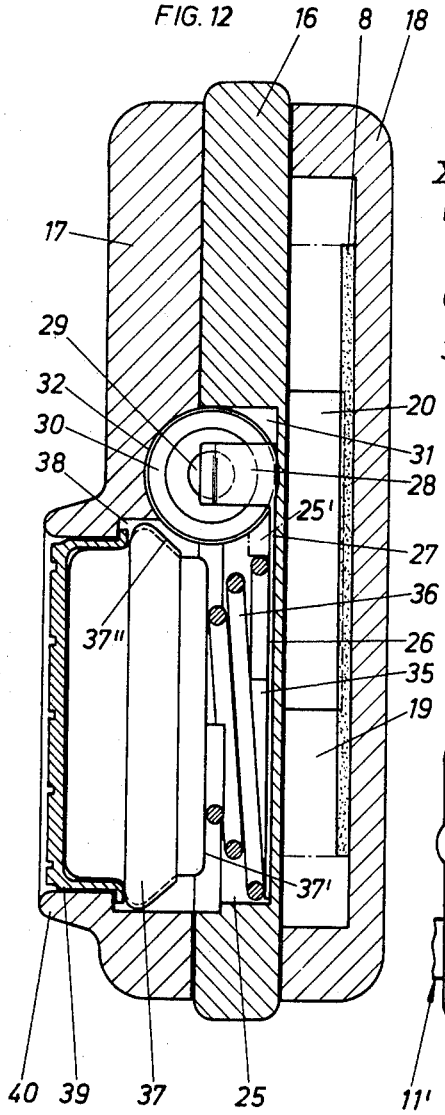
FIG. 12 is a section taken along the lines XII — XII of FIG. 11.
Figure 11:
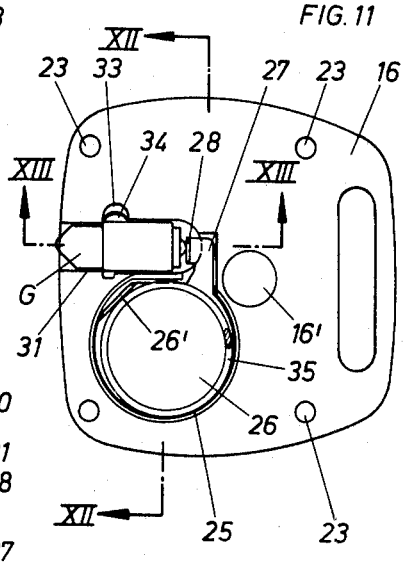
FIG. 11 is an enlarged plan view toward the base plate of FIGS. 5 – 10.
Figure 13:
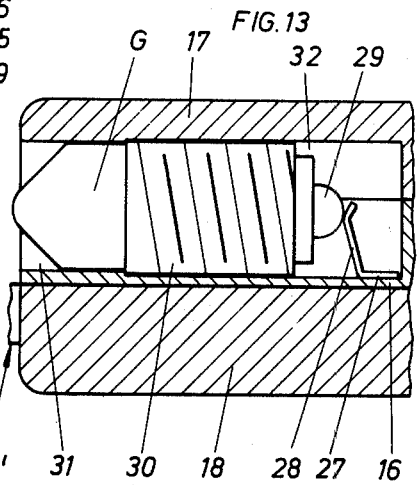
FIG. 13 is a section taken along the lines XIII — XIII of FIG. 11.

Referring now more particularly to FIGS. 11, 12 and 13, in the base plate 16 there is formed a pot-shaped recess 25 for the positive (i.e., without friction or without slipping) non-rotatable interpositioning insertion of a contact plate 26 therein. The non-rotatability is acheived by a laterally directed wing 27 of the contact plate 26. An angled-off contact finger 28 extends from the wing 27, the finger 28 stepping against the central contact 29 of the incandescent lamp G. The latter is supported in a recess 31 adjacent to the pot-shaped recess 25 as well as in a storage recess 32 of the housing cover 17. For the axial securing in position of the incandescent lamp G, the recess 31 is formed with another recess 33 in which there projects a soldering joint 34 on the lamp G.

The base winding-course 35 of a conically shaped pressure or compression spring 36 steps engagingly against the contact plate 26. This base winding-course 35 is held by an angled-off projection 26' of the contact plate 26, which braces or restrains the base winding-course 35 against the pot wall of the recess 25. The compression spring 36 is supported with its free end on a wide or width extending surface 37' of the button cell battery 37, the latter serving as the switch-on contact member for turning the light on. Further, the button battery cell 37 extends extensively and axially moveably in a bore 38 formed in the housing cover 17. The button battery cell 37 is actuated by means of the interpositioning of a push button shell member 39 on the battery cell 37, the member 39 being guided in a collar 40 of the housing cover 17 and adapted to be pressed by a person's finger. The collar 40 can also be disposed releasably or detachably on the housing, for example, by means of a screw- or plug in- turnable or twistable connection, so that the battery 37 indeed can be changed without opening the housing.

The contact making occurs on the one hand over the pole face 37, the compression spring 36 and the contact plate 26 via the finger 28 and the central contact 29 of the bulb G, and on the other hand, over the peripheral line 37'' of the button battery cell 37, which is tangent to the storage recess 32 and which steps against the jacket line of the incandescent lamp base 30 upon pressing the push button member 39 and thus the battery cell 37 against the force of the spring 36. The latter holds the battery cell 37 in the inoperative non-contacting position as shown in FIG. 12 in the absence of a person pressing the member 39.

The key 11, with clamping plate 18 removed from the remainder of the light housing, is inserted in the recess 19 of the same. Thereafter, the clamping plate 18 is to be coordinated to the remainder of the light housing. Subsequently, simply, only the clamping screw 2 is still to be screwed in.

Instead of the angled-off projection 26' (shown in FIG. 11) of the contact plate 26, also a projection 25' can be selected, which projection 25' extends material-wise-integrally from the base plate 16 and projects in the pot-shaped recess 25 (note dot dashed illustration in FIG. 12). Another possibility resides in centerizing the contact plate 26 by means of a central pin originating from the base of the pot-shaped recess 25, whereby the contact plate 26 would have a corresponding break-through opening through which the central pin would extend.

The plates 4 and 18, as also almost all other parts forming the housing, are preferably made of synthetic or plastic material. The self-sealing adhesive layer 8 is a common commercial material readily obtained on the market. The opposite surfaces, between which the key is secured, constitutes planar clamping cheek surfaces, on one of which surfaces the adhesive layer 8 is fixed thereon. The opposite planar clamping cheek surface in the embodiment of FIG. 12 is the right-hand most surface of the base plate 16 of the light housing.

While there has been disclosed several embodiments of the present invention, it is to be understood that these embodiments are given by illustration only and not in a limiting sense.

We claim:

1. A light and key combination adapted to be connected in a housing together, and receiving an incandescent bulb and battery, comprising a key having a handle with a surface formed with surface projections and a single hole therein and a key shank joined to said handle, a housing adapted to receive the battery and the bulb therein, said housing includes, a base plate and a clamping plate coordinated thereto, the latter defining an outer peripheral thickened edge substantially of the same peripheral size but larger than that of said handle of said key, at least two pins integral with and extending on opposite sides of said base plate, said thickened edge of said clamping plate is formed with openings in which said pins of said base plate are aligned and inserted in a coordinated condition of said base plate and said clamping plate, said thickened edge of said clamping plate abutting said base plate in said coordinated condition, said thickened edge defining a recess larger in surface area than that of said handle of said key and defining a slot transferring into and communicating with said recess for passage of said key shank through said slot, said slot formed wider than said key shank, said clamping plate defining a first planar clamping cheek surface in said recess enlarged in surface area relative to said handle of said key, said base plate including a second planar clamping cheek surface spaced parallel and opposite to said first planar clamping cheek surface, said key handle being disposed in said recess between said first and second planar clamping cheek surfaces, said housing further includes a housing cover formed with second openings, said base plate being positioned between said clamping plate and said housing cover, said pins on said base plate extending into said second openings in said housing cover, whereby said housing cover is coordinated to said base plate, a double-sided sticking self-sealing adhesive layer means disposed in said recess adhered to said first planar clamping cheek surface for releasably adhering said handle of said key thereto, releasable clamping means for releaseably clampingly pressing together said base plate and said clamping plate and said housing cover, as well as said first clamping cheek surface with said adhesive layer means thereon against said handle of said key, said handle with said surface projections being pressed into said adhesive layer means thereby clamping said key pressingly against said self-sealing adhesive layer means, whereby said key is non-rotatably secured in said housing, said base plate is formed with an enlarged bore, said clamping means comprises a single screw having a threaded shank extending through said single hole of said handle of said key and through said enlarged bore of said base plate, said housing cover is formed with a collar complementarily projecting into said enlarged bore of said base plate terminating therein spaced from said handle of said key and being formed with a threaded opening in said collar, said threaded shank of said screw threadedly engages in said threaded opening, said base plate and said housing cover are formed with recess means for cooperatively receiving the bulb and the battery therein, and said housing cover and said clamping plate have substantially the same thickness and outer peripheral shape, and said base plate extends therebetween in a direction opposite than that of said key shank and is formed with a slot therein, said recess of said clamping plate having a thickness smaller than the combined thickness of said handle of said key and the thickness of said self-sealing adhesive layer means.

2. A light adapted to be connected with a key, and receiving an incandescent bulb and battery, the key having a handle with a hole therein, comprising a housing adapted to receive the battery and bulb therein and including a surface, a self-sealing adhesive layer disposed on said surface of said housing, means for clamping a key against said self-sealing adhesive layer on said surface of said housing and for passing through the hole in the handle of the key, said housing includes a base plate and a housing cover coordinated together, said base plate is formed with a pot-shaped recess, a contact plate positively non-rotatably interpositioned in said pot-shaped recess, said contact plate includes a laterally directed wing having an angled-off contact finger adapted to engage a central contact of the bulb, said base plate is formed with a first recess means adjacent to said pot-shaped recess, said first recess means for partly receiving the bulb therein, said housing cover is formed with a storage recess means for partly receiving the bulb therein, a compression spring means disposed on and extending above said contact plate and having a free end for being supported on a width extending surface of the battery, the latter serving as a switch-on contact member, a peripheral line of the battery being tangential to the storage recess means.

3. The light as set forth in claim 2, wherein said compression spring is conical in shape.

4. The light as set forth in claim 2, wherein said contact plate has a projection means for holding said compression spring.

5. The light as set forth in claim 2, wherein said housing cover is formed with a bore communication with said storage recess means, a button battery cell means having a pole bottom contact surface abutting said compression spring and moveably disposed in said bore against force of said spring, said button battery cell means having a peripheral line pole contact part tangential to said storage recess means for making contact with a base of the bulb upon pressing movement of said button battery cell means.

* * * * *